US006481092B2

(12) United States Patent
Buttrick, Jr. et al.

(10) Patent No.: US 6,481,092 B2
(45) Date of Patent: Nov. 19, 2002

(54) ELECTROMAGNETIC COIL, AND METHOD AND APPARATUS FOR MAKING SAME

(75) Inventors: James N. Buttrick, Jr., Seattle, WA (US); Kostandinos Papanikolaou, Southfield, MI (US); David Paul Banks, Lake Stevens, WA (US); Paul Reuben Arntson, Bothell, WA (US)

(73) Assignee: The Boeing Company, Seattle, WA (US)

( * ) Notice: Subject to any disclaimer, the term of this patent is extended or adjusted under 35 U.S.C. 154(b) by 0 days.

(21) Appl. No.: 09/793,657

(22) Filed: Feb. 26, 2001

(65) Prior Publication Data

US 2002/0118088 A1 Aug. 29, 2002

(51) Int. Cl.[7] ..... H01F 7/06
(52) U.S. Cl. ..... 29/602.1; 29/606
(58) Field of Search ..... 29/602.1, 606; 336/83, 84 R, 183, 200, 205–6, 223, 208, 226, 232, 192, 198

(56) References Cited

U.S. PATENT DOCUMENTS

| | | | | |
|---|---|---|---|---|
| 3,453,463 A | | 7/1969 | Wildi | |
| 3,559,269 A | | 2/1971 | Schmitt et al. | |
| 3,704,506 A | | 12/1972 | Orr et al. | |
| 3,737,990 A | | 6/1973 | Schut | |
| 3,811,313 A | | 5/1974 | Schut | |
| 4,128,000 A | | 12/1978 | Hogenhout et al. | |
| 4,132,108 A | | 1/1979 | Hogenhout | |
| 4,151,640 A | * | 5/1979 | McDermott et al. | 29/605 |
| 4,151,735 A | | 5/1979 | McDermott | |
| 4,417,463 A | | 11/1983 | Nelson | |
| 4,420,876 A | | 12/1983 | McDermott | |
| 4,423,620 A | | 1/1984 | Hogenhout et al. | |
| 4,472,216 A | | 9/1984 | Hogenhout et al. | |
| 4,481,709 A | | 11/1984 | McDermott | |
| 4,516,104 A | | 5/1985 | McDermott | |
| 4,543,555 A | | 9/1985 | McDermott | |
| 4,862,043 A | | 8/1989 | Zieve | |
| 4,895,322 A | | 1/1990 | Zieve | |
| 5,046,345 A | | 9/1991 | Zieve | |
| 5,252,941 A | | 10/1993 | Pitzele et al. | |
| 5,296,830 A | * | 3/1994 | Tamada et al. | 336/192 |
| 5,398,537 A | | 3/1995 | Michalewski et al. | |
| 5,404,633 A | | 4/1995 | Givler | |
| 5,471,865 A | | 12/1995 | Michalewski et al. | |
| 5,575,166 A | | 11/1996 | Michalewski et al. | |
| 5,748,064 A | | 5/1998 | Smeenge et al. | |
| 5,952,908 A | * | 9/1999 | Kubo | 336/192 |

FOREIGN PATENT DOCUMENTS

| | | | |
|---|---|---|---|
| JP | 3-155106 | * | 3/1991 |

* cited by examiner

*Primary Examiner*—Lincoln Donovan
(74) *Attorney, Agent, or Firm*—Alston & Bird LLP

(57) ABSTRACT

An electromagnetic coil assembly particularly suited for use in high-acceleration impact devices includes an inner hub having a flat metal and dielectric strip wound thereabout to form a coil, and an outer body mounted about the inner hub against one side of the coil. Inner and outer coil leads are formed by flat 90° bends of the inner and outer ends of the coil strip, such that the coil leads extend axially away from the coil toward one end of the coil assembly. Recesses are formed in the end faces of the inner hub and outer body at this end of the assembly, and the coil leads are folded into these recesses and attached by lug connectors to a pair of electrical conductors that lead out the side of the coil assembly. The coil leads and conductors are secured in the recesses, preferably by potting them in place.

6 Claims, 4 Drawing Sheets

ELECTROMAGNETIC COIL, AND METHOD AND APPARATUS FOR MAKING SAME

FIELD OF THE INVENTION

The invention relates to electromagnetic coils. The invention relates more particularly to electromagnetic coils in which the coil is formed of a flat metal and dielectric strip wound onto an inner hub, and to methods and apparatus for making such coils.

BACKGROUND OF THE INVENTION

Coils of the above-described type are commonly used in high-energy impact devices such as electromagnetic riveters (EMR), dent removal equipment, and the like. Exemplary coil constructions and manufacturing methods for such coils are described in U.S. Pat. Nos. 4,151,640 and 4,146,858, the entire disclosures of which are incorporated herein by reference. The coil disclosed in these patents has an end portion of the strip at the innermost turn of the coil bent 180° about an axis lying in the plane of the strip and extending diagonally across the width of the strip such that the strip is folded upon itself, thereby creating a terminal lead for the coil that exits the coil in an axial direction; likewise, the end portion of the strip at the outermost turn of the coil is bent in the same fashion to create an outer terminal lead for the coil extending in the axial direction. The inner and outer terminal leads are then bent a second time through 90° bends to direct them radially outwardly from the coil for attachment to electrical conductors that extend away from the coil in the radial direction. The fold regions of the strip represent potential locations for fatigue failure because of the electromagnetic forces and the mechanical stress risers that are generated at the folds.

Another drawback of the above-mentioned coil arises when the coil is a moving coil, such as when used as the moving coil of a dual-coil EMR gun. In this type of application, high accelerations are imposed on the coil along the central longitudinal axis of the coil, and hence large stresses tend to be exerted on the electrical conductors. Unless the connections between the coil leads and the electrical conductors are carefully designed and the connections and conductors are properly secured, which is typically not the case, these stresses can cause the connections between the conductors and the coil terminal leads to loosen over time, resulting in arcing and possible coil terminal damage.

SUMMARY OF THE INVENTION

The present invention seeks to overcome the drawbacks noted above by providing a coil assembly, and methods and apparatus for making a coil assembly, in which the terminal leads are formed without folding the coil strip, thereby eliminating or at least greatly reducing the potential for fatigue failure of the strip, and in which the connections between the terminal leads and the electrical conductors are secured in a fashion that substantially reduces the stresses imposed on the conductors and connections.

To these ends, an electromagnetic coil assembly in accordance with one preferred embodiment of the invention includes an inner hub having a central longitudinal axis, and a ring-shaped outer body mounted about the inner hub generally concentric with the longitudinal axis. The coil assembly further includes a coil wound about the inner hub. The coil comprises a flat strip having opposite planar surfaces, the strip being wound about the inner hub in a spiral fashion. The strip generally comprises a flat strip of conductive metal such as copper, and a dielectric material covering at least one of the planar surfaces of the metal strip. In a preferred embodiment, the dielectric material comprises a dielectric fiber material such as fiberglass that is impregnatable or pre-impregnated with a curable binder. The coil has an inner coil lead comprising an inner end portion of the flat strip extending generally axially away from the coil and being joined integrally with the inner turn of the coil at an inner bend region of the strip. The coil also has an outer coil lead comprising an outer end portion of the flat strip extending generally axially away from the coil and being joined integrally with the outer turn of the coil at an outer bend region of the strip. The inner and outer bend regions of the strip are characterized by an absence of folding of the strip onto itself.

More particularly, it is preferred to form the bend regions as flat bends of about 90°. That is, the strip at its inner and outer ends is bent through an angle of substantially 90° about a bend axis that is substantially perpendicular to the opposite planar surfaces of the strip, thereby forming terminal leads that extend in the axial direction parallel to the central longitudinal axis of the coil. In this way, folding of the strip onto itself is avoided.

To substantially reduce mechanical stress on the coil terminal leads and the connections to the electrical conductors, the end faces of the inner hub and outer body have recesses formed in them. The inner terminal lead extends into a recess in the inner hub and is connected to an electrical conductor within the recess by a terminal connector. The outer terminal lead similarly extends into a recess in the outer body and is connected to an electrical conductor within the recess by a terminal connector. The terminal connectors are secured within the recesses. Preferably, the terminal connectors and electrical conductors are secured by potting them in place in the recesses with an elastomeric potting compound, and then a substantially rigid plate is attached across the end faces of the inner hub and outer body so as to cover the potted-in terminal connectors and conductors. This arrangement substantially reduces the stresses on the coil leads and electrical conductors. The elastomeric potting compound preferably allows the electrical conductors to have a slight amount of "give" when accelerations are imposed on the coil assembly.

An apparatus for making a coil assembly in accordance with the invention includes a bending device operable to bend a flat coil strip about a bend axis substantially perpendicular to opposite planar surfaces of the strip to form a substantially 90° flat bend in the strip, and a winding device structured and arranged to grip a generally cylindrical inner hub of the coil assembly with the strip secured thereto, and to rotate the inner hub about a central longitudinal axis of the inner hub to cause the strip to be wound about the inner hub.

In a preferred embodiment, the bending device comprises a clamp for clamping the strip in a fixed position with an end portion of the strip projecting out therefrom, and a rotatable bending assembly operable to bend the end portion of the strip to form a circular-arc bend in the strip. The rotatable bending assembly preferably comprises a pair of rollers each defining a strip-receiving slot extending circumferentially therearound and arranged on opposite side edges of the strip such that each side edge of the strip is received within one of the slots. The rollers are mounted on a lever that is rotatable relative to the clamp about a rotation axis substantially perpendicular to the planar surfaces of the strip mounted in the clamp, such that rotation of the lever about the rotation axis causes the strip to be bent.

A coil assembly is manufactured in the apparatus by forming a 90° flat bend at one end of the coil strip to form the inner coil lead. This end of the strip is then secured to the inner hub mounted in the winding device, and the winding device is operated to rotate the inner hub to wind the strip onto the hub under tension. The opposite end of the strip is processed in the bending device to form a 90° flat bend to create the outer coil lead, preferably in such a manner that both the inner and outer coil leads exit the coil in the same direction parallel to the central longitudinal axis of the coil. The winding of the strip onto the inner hub is then completed and the strip is clamped to the hub to prevent unwinding. The outer body is then mounted to the assembly of the inner hub and coil.

The coil assembly is then clamped between a pair of tooling plates disposed against the opposite end faces of the coil assembly, the tooling plate and coil assembly is wrapped with a silicone sheet, and the entire assembly is placed in a vacuum bag and is cured in an autoclave while vacuum is drawn on the bag. The bagging and autoclave curing facilitate production of a coil substantially free of voids in the dielectric material isolating adjacent coil turns from each other.

After curing of the coil dielectric and removal of the tooling plates, fastener holes are drilled in the coil leads and mechanical fasteners are used to connect the coil leads to a pair of conductor wires. The coil leads and wires are laid into the recesses in the end faces of the inner hub and outer body and are potted in place. A rigid plate is then secured across the end faces to cover the potted-in coil leads and conductor wires to complete the coil assembly.

BRIEF DESCRIPTION OF THE DRAWINGS

The above and other objects, features, and advantages of the invention will become more apparent from the following description of certain preferred embodiments thereof, when taken in conjunction with the accompanying drawings in which.

DETAILED DESCRIPTION OF THE DRAWINGS

Figure 1:
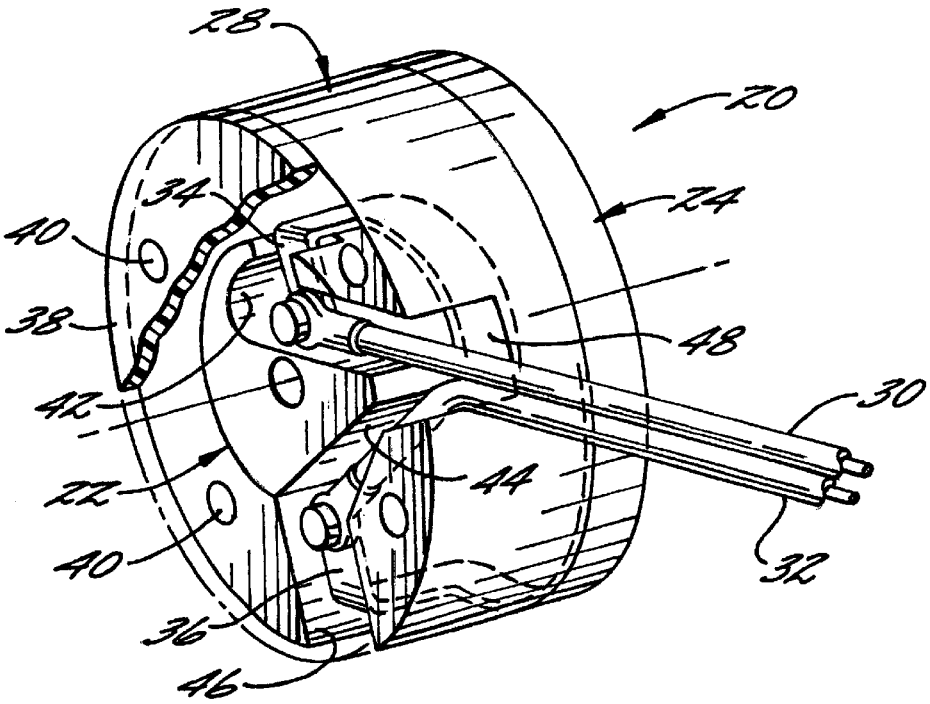
FIG. 1 is a perspective view of an electromagnetic coil assembly in accordance with one preferred embodiment of the invention, with a portion of the cover plate broken away and without potting compound so that the coil leads and electrical conductors can be seen laying in the recesses in the inner hub and outer body.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

FIGS. 1 through 4 depict an electromagnetic coil assembly 20, and components thereof, in accordance with a preferred embodiment of the invention. The coil assembly 20 generally comprises an inner hub 22, a coil 24 composed of a flat coil strip 26 wound in a plurality of turns about the inner hub 22 so as to form a generally annular coil, an outer body 28 mounted about the inner hub and against one of the end faces of the coil 24, a pair of electrical conductors 30 and 32 respectively connected to inner and outer coil leads 34 and 36 of the coil 24, and a cover plate 38 secured by fasteners 40 against the end faces of the outer body and inner hub.

Figure 2:
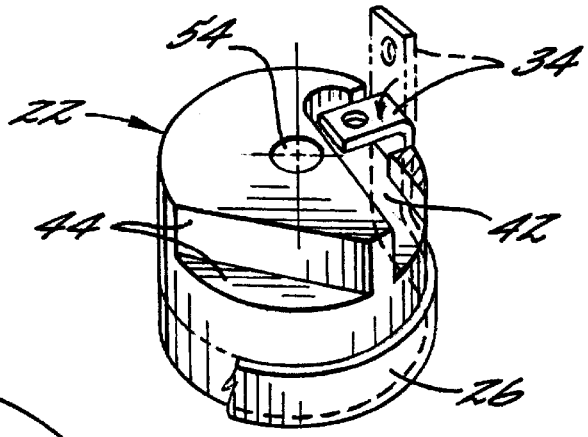
FIG. 2 is a perspective view of the inner hub of the coil, showing the 90° bend of the inner turn of the coil strip in phantom lines prior to being folded into the recess in the inner hub, and in solid lines after being folded into the recess.

The inner hub 22 comprises a generally cylindrical body preferably formed of a suitable dielectric material such as a phenolic resin, which may or may not include reinforcing material such as paper, glass fibers, polyester fibers, or the like. Preferably, the inner hub 22 is formed of a phenolic resin-based material sold under the trademark MICARTA. The inner hub 22 is preferably longer in axial extent that the width of the coil strip 26 so that when the coil strip 26 is wound about one end of the inner hub, the opposite end of the inner hub extends axially beyond the resulting coil, as best seen in FIG. 2. The end face of this opposite end of the inner hub 22 includes a recess 42 therein for receiving the inner coil lead 34, and also includes a relief 44 for accommodating the electrical conductor 32 that is attached to the outer coil lead 36.

The outer body 28 comprises a generally ring-shaped body preferably formed of a suitable dielectric material similar to that of the inner hub. The end face of the outer body 28 that is against the end face of the coil 24 is generally planar. The opposite end face of the outer body includes a recess 46 for receiving the outer coil lead 36, and also includes a recess 48 for accommodating the electrical conductors 30 and 32. The inner diameter of the outer body 28 is sized such that the inner hub fits closely within the outer body. The outer diameter of the outer body 28 preferably is about equal to or slightly greater than the outer diameter of the coil 24. The recesses 46 and 48 are respectively located so as to be generally aligned with the relief 44 and the recess 42 in the inner hub when the inner hub is mounted within the outer body. In this manner, the recess 46, the relief 44, and the recess 48 collectively form a continuous channel or depression in which the outer coil lead 36 and its associated electrical conductor 32 lie such that they are recessed below the end faces of the inner hub and the outer body, which end faces are substantially flush with each other. Similarly, the recess 42 in the inner hub and the recess 48 in the outer body form a continuous channel or depression in which the inner coil lead 34 and its associated electrical conductor 30 lie such that they are recessed below the end faces of the inner hub and outer body.

The inner coil lead 34 is formed by bending the end of the coil strip 26 at the innermost turn of the coil through an angle of 90° about a bend axis perpendicular to the planar surfaces of the strip such that the end portion of the strip extends in the axial direction. This axially extending portion of the strip preferably is longer than the axial length of the inner hub so that the end of the strip can be folded into the recess 42 in the inner hub as shown in FIG. 2.

Figure 3:
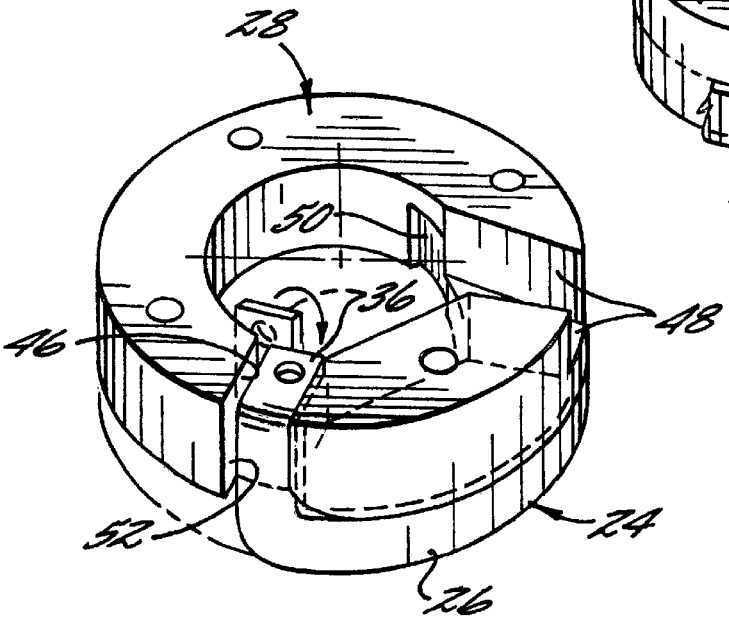
FIG. 3 is a perspective view of the outer body of the coil, showing the 90° bend of the outer turn of the coil strip in phantom lines prior to being folded into the recess in the outer body, and in solid lines after being folded into the recess.
Figure 4:
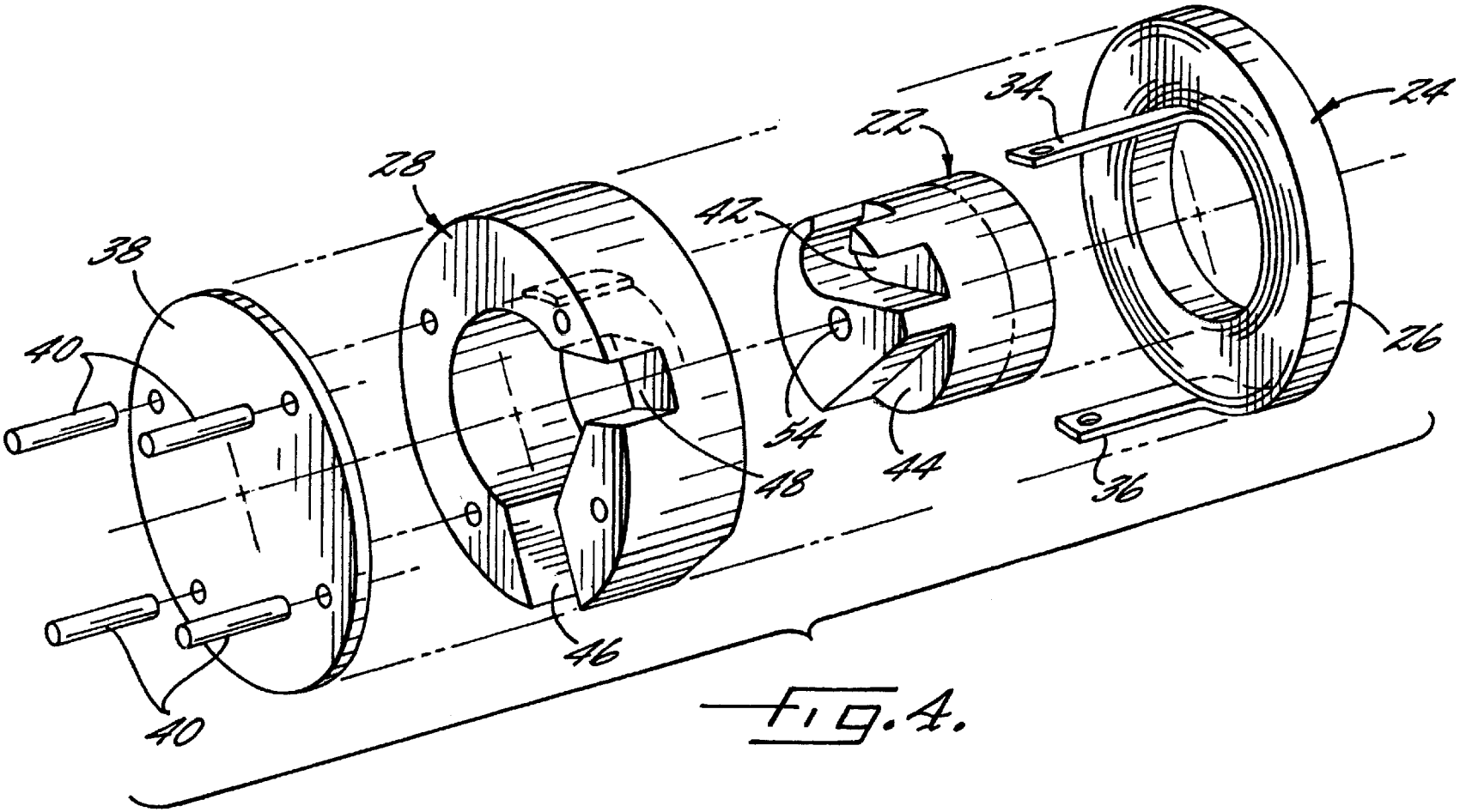
FIG. 4 is an exploded perspective view of the electromagnetic coil assembly of FIG. 1.

The outer coil lead 36 is similarly formed by bending the end of the coil strip 26 at the outermost turn of the coil through an angle of 90° about a bend axis perpendicular to the planar surfaces of the strip such that the end portion of the strip extends in the axial direction, and this axially extending portion of the strip is longer than the inner hub so that the end of the strip can be folded into the recess 46 in the outer body as shown in FIG. 3. The radially inner surface of the outer body 28 includes a relief 50 for accommodating the axial portion of the inner coil lead 34, and the radially outer surface of the outer body includes a relief 52 for accommodating the axial portion of the outer coil lead 36.

Thus, when the inner hub 22 is mounted within the outer body 28 with the coil 24 wound about the portion of the inner hub that extends axially beyond the outer body and the inner and outer coil leads are folded into their respective recesses, the assembly of the inner hub, outer body, and coil forms a generally cylindrical structure.

The coil strip 26 comprises a strip of a conductive metal such as copper, with a layer of a suitable dielectric material such as fiberglass covering one of the major surfaces of the strip; alternatively, the dielectric material can be wrapped entirely about the strip in a helical fashion. Thus, when the strip is wound to form the coil 24, adjacent turns of the metal strip are electrically insulated from each other by the dielectric material. The dielectric material can be a dry fibrous material that is impregnated with a resin binder after winding of the coil. Preferably, however, the dielectric material comprises a pre-impregnated composite material such as glass fibers held within a partially cross-linked polymer matrix (i.e., a B-stage composite material).

Once the coil 24 is wound about the inner hub 22 and the inner hub and outer body 28 are assembled together, the entire assembly is secured between a pair of tooling plates (not shown) via a bolt that passes through a central bore 54 in the inner hub 22. The tooling plates clamp the coil assembly therebetween so as to ensure that the coil 24 has a flat and smooth face. The assembly of the coil and tooling plates is then wrapped with a silicone sheet and the entire package is placed in an autoclave bag (not shown) for curing of the coil in an autoclave. After the coil has cured, the autoclave bag, silicone sheet, and tooling plates are removed. Fastener holes are drilled in the inner and outer coil leads 34, 36 and the electrical conductors 30, 32 are connected to the coil leads with lug connectors or a similar type of mechanical connector as shown in FIG. 1. The coil leads, lug connectors, and conductors are folded into the recesses in the inner hub and outer body and are suitably secured. Mechanical fasteners could be used for securing the leads and conductors in the recesses. Preferably, however, the coil leads and conductors are potted in place within the recesses with an elastomeric potting compound that fills the void spaces in the recesses. The potting compound secures the leads and conductors so that they are generally fixed in place, yet allows some "give" so as to serve a strain-relieving function. Once the leads and conductors are potted in place, the cover plate 38 is secured against the end of the coil assembly with the fasteners 40, which engage corresponding holes in the outer body 28. The cover plate 38 may be a dielectric material as shown in FIG. 1, but more preferably comprises a metal such as steel so as to impart rigidity to the entire coil assembly. In applications where such rigidity is not needed, the cover plate could be made of a lower-strength material or could be omitted entirely.

FIGS. 5 through 9 depict an apparatus 100 for making an electromagnetic coil assembly in accordance with the invention. The apparatus 100 includes a pay-off reel (not shown) for mounting a roll of the metal-dielectric coil strip 26, a bending device 102 for forming the flat bends in the coil strip, and a winding device 104 for winding the coil strip about the inner hub of the coil assembly.

Figure 7:
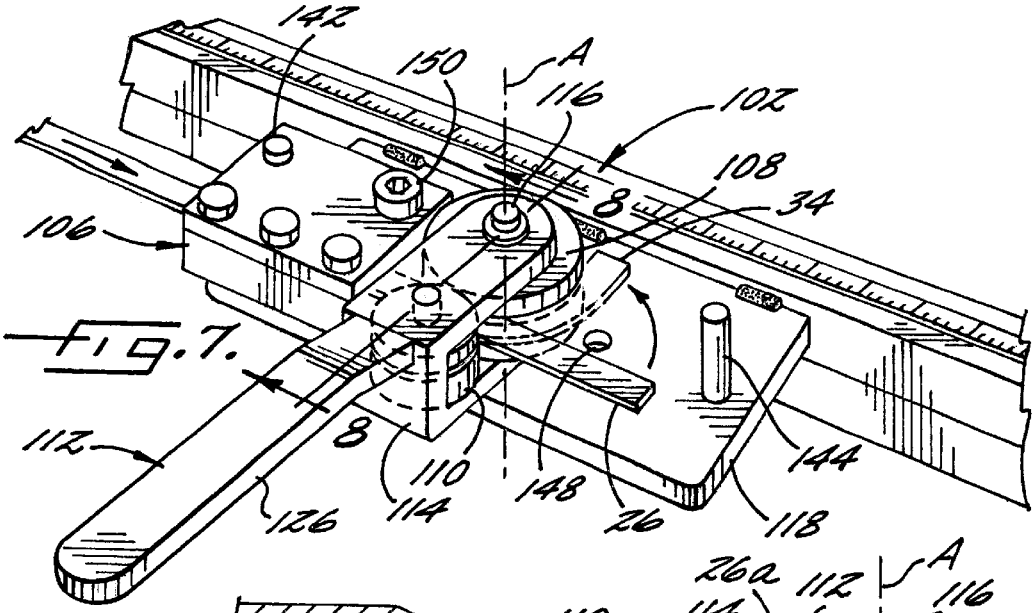
FIG. 7 is a perspective view of a bending device of the apparatus, illustrating the formation of the flat bend at the inner end of the coil strip prior to beginning to wind the strip onto the inner hub.
Figure 8:
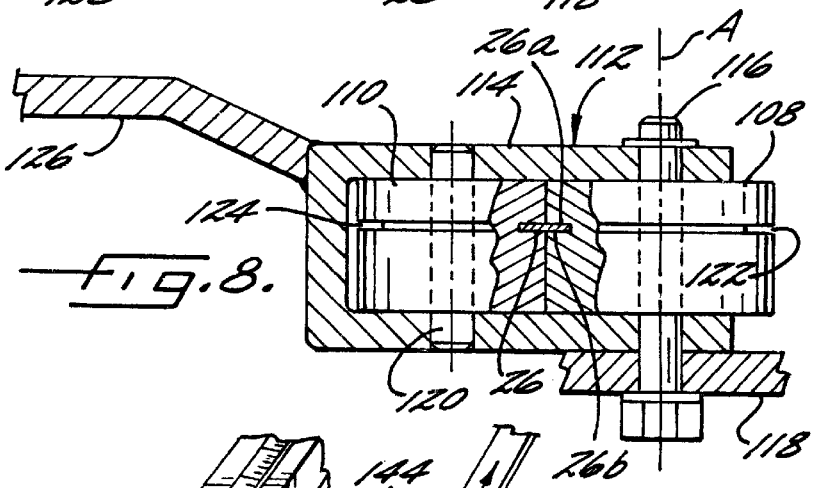
FIG. 8 is a cross-sectional view of the bending device taken on line 8—8 of FIG. 7.

The coil manufacturing process begins by advancing the leading end of the coil strip 26 from the supply roll to the bending device 102 and inserting the strip into the bending device as shown in FIG. 7. The bending device includes a clamp 106 for holding the strip 26 in a fixed plane with an end portion of the strip protruding out from one side of the clamp. This end portion of the strip is inserted into a rotatable bending assembly comprising a fixed cylindrical roll 108 and a movable cylindrical roll 110 and a rotatable lever assembly 112 for rotating the roll 110 about the axis of the roll 108. The fixed roll 108 is mounted between the legs of a generally U-shaped yoke 114 of the lever assembly 112 by a pivot pin 116 that also passes through a stationary support plate 118 so as to rotatably mount the fixed roll 108 and yoke 114 onto the support plate. The movable roll 110 is also mounted between the legs of the yoke 114 by a pivot pin 120, such that rotation of the yoke about its pivot axis defined by the pivot pin 116 causes the movable roll 110 to rotate about the axis of the fixed roll 108. The two rolls 108, 110 have their outer cylindrical surfaces abutting each other. The fixed roll 108 has a groove 122 formed in its outer cylindrical surface extending circumferentially about the roll, and the movable roll 110 has a similar groove 124 formed in its outer surface in alignment with the groove 122. The grooves are slightly wider than the thickness of the coil strip 26 and each groove has a depth in the radial direction of the roll that is about half the width of the coil strip. Thus, the leading end of the coil strip 26 can be inserted between the rolls 108 and 110 with the opposite side edges of the strip received in the grooves 122, 124 as shown in FIGS. 7 and 8.

Initially, the leading end of the coil strip is straight as shown in solid lines in FIG. 7. To form a flat bend in the strip, the lever assembly, comprising the yoke 114 and a handle 126 rigidly affixed to the yoke, is rotated about the pivot pin 116 in the counterclockwise direction in FIG. 7. Because the strip 26 is constrained by the clamp 106 and the rolls 108, 110 to remain in the same plane, the rotation of the roll 110 about the fixed roll 108 causes the strip to be bent about a bending axis A (see FIGS. 7 and 8) that is perpendicular to the planar surfaces 26*a* and 26*b* (FIG. 8) of the strip, as shown in phantom lines in FIG. 7. The lever assembly is rotated through an angle sufficient to bend the strip 90°, thereby forming the inner coil lead 34 as shown in FIG. 7.

The next step in the manufacturing process is to wind the coil strip onto the inner hub 22. The winding device 104 includes a rotatable take-up reel 128 that receives the inner hub 22 into a central cylindrical recess and has a spindle 130 that extends through the center bore 54 of the inner hub so as to fix the inner hub relative to the take-up reel 128. The inner hub 22 is mounted in the take-up reel 128 such that the recess 42 for the inner coil lead faces into the central recess of the take-up reel. The take-up reel 128 is connected to a drive shaft 132 that is coupled to an output side of a right-angle worm-drive gear box 134, and a hand wheel 136 is coupled to an input side of the gear box 134. Rotation of the hand wheel 136 causes the take-up reel 128 to rotate about the axis of the spindle 130, thereby rotating the inner hub 22 about its axis. Of course, a motor could be substituted for the manual hand wheel 136, if desired. The take-up reel 128 also includes a receptacle (not shown) for receiving the axially extending inner coil lead 34 of the coil strip. The inner hub 22 is mounted in the take-up reel 128 so that the recess 42 in the inner hub is rotationally aligned with the receptacle in the take-up reel that receives the inner coil lead 34.

Figure 5:
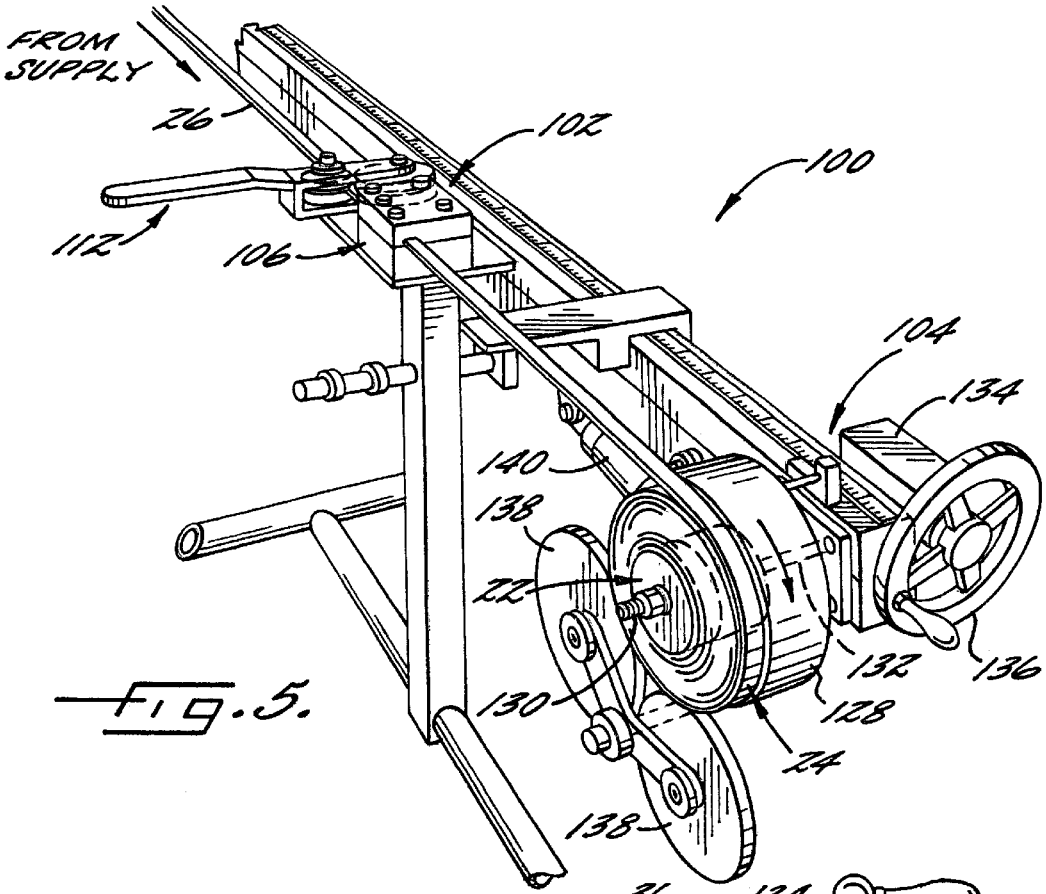
FIG. 5 is a perspective view of an apparatus for making an electromagnetic coil assembly in accordance with a preferred embodiment of the invention, showing a coil strip being wound onto an inner hub mounted in a winding device of the apparatus.
Figure 6:
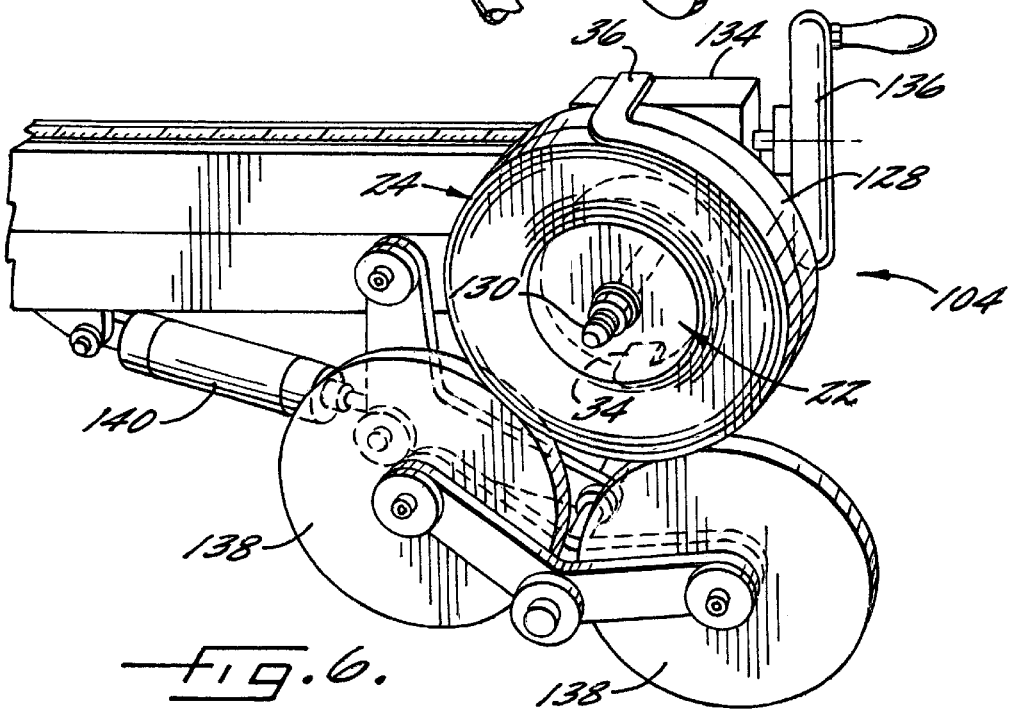
FIG. 6 is a perspective view of the winding device of the apparatus, showing the coil strip fully wound onto the inner hub.

To wind the coil strip 26 onto the inner hub 22, the bent inner coil lead 34 is inserted into the receptacle in the take-up reel 128, and the hand wheel 136 is turned so as to rotate the take-up reel 128 clockwise in FIG. 5, which causes the coil strip 26 to be wound about the inner hub 22. The winding device 104 includes a pair of compaction rollers 138 that are urged by a suitable spring 140 into engagement with the coil being wound onto the inner hub. The compaction rollers apply a generally constant pressure on the coil so that the coil will not unwind in the event that tension on the coil strip is released for any reason.

Figure 9:
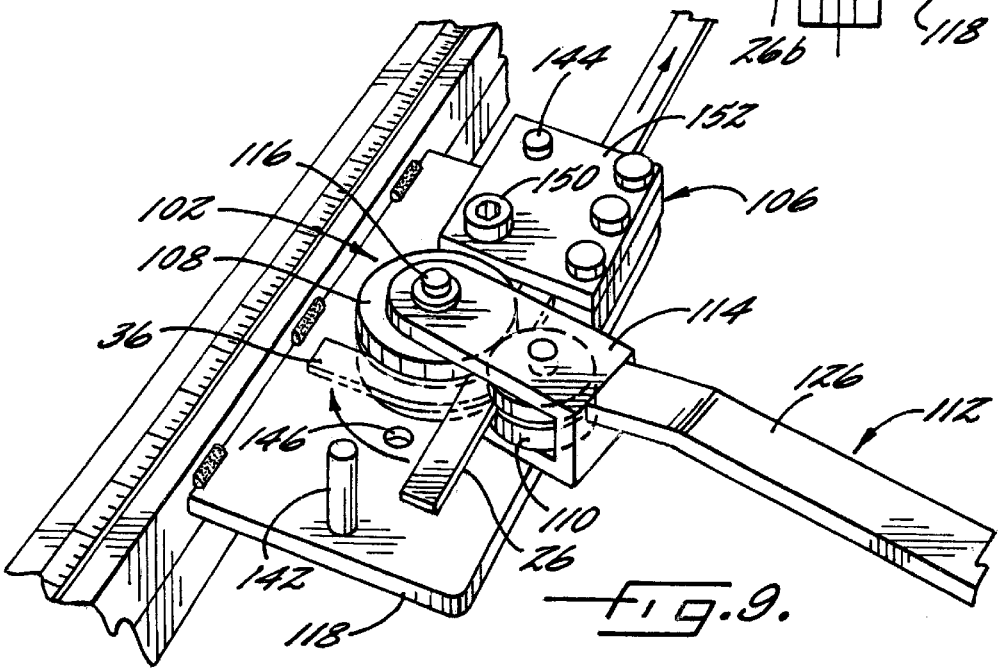
FIG. 9 is a perspective view of the bending device, showing the formation of the flat bend at the outer end of the coil strip.

The hand wheel 136 is rotated so as to wind a desired number of turns of the coil strip onto the inner hub. The location along the outermost winding of the coil where it is desired to form the bent outer coil lead is marked on the coil strip and the strip is cut at the appropriate location, and then the end of the coil strip is pulled back (to the left in FIG. 5) and inserted into the bending device 102 so that the outer coil lead can be formed. In order to form the bend for the outer coil lead 36, the clamp 106 is moved on the support plate 118 to the opposite side of the pivot pin 116 from where the clamp was located for forming the inner coil lead, as shown in FIG. 9. The support plate 118 includes a pair of locator pins 142 and 144 respectively mounted on the upstream and downstream sides of the pivot pin 116, and the clamp 106 includes a bore for receiving one or the other of the locator pins depending on which side of the pivot pin the clamp is mounted. The support plate 118 also includes a pair of holes 146 and 148 respectively located on opposite sides of the pivot pin 116 for receiving a fastener 150 that secures the clamp 106 to the support plate. Thus, when forming the inner coil lead as shown in FIG. 7, the clamp 106 is mounted on the locator pin 142 and the fastener 150 engages the hole 146; when forming the outer coil lead as shown in FIG. 9, the clamp 106 is mounted on the locator pin 144 and the fastener 150 engages the hole 148.

The outer coil lead 36 is formed by rotating the lever assembly 112 clockwise in FIG. 9 to bend the end of the coil strip through an angle of 90° as indicated in phantom lines. The clamp 106 is then removed from the strip 26 by removing a top plate 152 of the clamp so that the bend outer coil lead 36 can be wound back onto the coil. The coil and inner hub are clamped together with a suitable clamp (not shown), and the inner hub and coil are removed from the winding device 104 and joined to the outer body. The remainder of the coil fabrication process then proceeds as previously described.

Many modifications and other embodiments of the invention will come to mind to one skilled in the art to which this invention pertains having the benefit of the teachings presented in the foregoing descriptions and the associated drawings. For example, while the inner and outer coil leads are described as being formed by flat bends of the coil strip about axes perpendicular to the planar surfaces of the strip, the bending axes could instead be non-perpendicular to the strip so that the strip has some component of twist, as long as sharp folds of the strip are avoided. The locations of the recesses that accommodate the coil leads and conductors could be varied; for instance, both of the recesses could be provided in the outer body. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A method for making an electromagnetic coil assembly, comprising:

providing a flat strip comprising a bendable electrically conductive metal, the strip having opposite planar surfaces at least one of which is covered by a dielectric material, the strip having opposite first and second end portions;

bending the first end portion of the strip about a bend axis that is substantially perpendicular to the planar surfaces of the strip through an angle of substantially 90°;

bending the second end portion of the strip about a bend axis that is substantially perpendicular to the planar surfaces of the strip through an angle of substantially 90°;

winding the strip about an inner hub having a central longitudinal axis such that the bent first and second end portions of the strip extend generally parallel to the central longitudinal axis of the inner hub, so as to form a coil on the inner hub with the bent first and second end portions of the strip forming inner and outer coil leads that extend axially away from the coil; and connecting an electrical conductor to each of the coil leads.

2. The method of claim 1, further comprising mounting an outer body about the inner hub against one side of the coil from which the inner and outer coil leads extend.

3. The method of claim 2, wherein the inner hub and outer body each is provided to have a generally planar end face in which a recess is defined for receiving the respective one of the inner and outer coil leads, and wherein the electrical conductors are terminated and connected to the coil leads within the recesses.

4. The method of claim 3, wherein the electrical conductors are connected to the coil leads by terminal connectors, and the terminal connectors and electrical conductors are secured within the recesses.

5. The method of claim 4, wherein the terminal connectors and electrical conductors are potted in place in the recesses.

6. The method of claim 5, further comprising attaching a substantially rigid plate across the end faces of the inner hub and outer body covering the terminal connectors and electrical conductors that are potted in the recesses.

* * * * *